US006702303B1

(12) United States Patent
Kolsum

(10) Patent No.: US 6,702,303 B1
(45) Date of Patent: Mar. 9, 2004

(54) ROLLER SKATE VEHICLE WITH SEAT

(75) Inventor: Eric L. Kolsum, 6900 Hillside La., Edina, MN (US) 55439

(73) Assignee: Eric L. Kolsum, Edina, MN (US)

( * ) Notice: Subject to any disclaimer, the term of this patent is extended or adjusted under 35 U.S.C. 154(b) by 0 days.

(21) Appl. No.: 09/283,445

(22) Filed: Apr. 1, 1999

(51) Int. Cl.[7] ..... A63C 17/01

(52) U.S. Cl. ..... 280/11.19; 280/11.27; 280/87.01

(58) Field of Search ..... 280/11.19, 11.22, 280/11.26, 11.27, 11.28, 809, 816, 87.01, 87.021, 87.042

(56) References Cited

U.S. PATENT DOCUMENTS 197,385 A * 11/1877 Lumbee ..... 280/11.19
3,528,676 A * 9/1970 Marcandalli ..... 280/79.5
D232,108 S * 7/1974 Krause ..... 280/11.19
4,342,466 A * 8/1982 Morgan ..... 280/87.03
5,114,166 A 5/1992 McCosker ..... 280/87.042
5,354,081 A * 10/1994 Huffman et al. ..... 280/87.03
5,427,391 A * 6/1995 Cooper ..... 280/11.19
5,833,252 A 11/1998 Strand ..... 280/87
5,915,707 A 6/1999 Steffen ..... 280/87.03
5,979,939 A * 11/1999 Siboni ..... 280/809

* cited by examiner

*Primary Examiner*—Richard M. Camby
(74) *Attorney, Agent, or Firm*—Vidas, Arrett & Steinkraus, P.A.

(57) ABSTRACT

A roller skate vehicle which includes a standard roller skate frame having two pairs of axle mounted wheels and a padded seat mounted thereon.

5 Claims, 4 Drawing Sheets

ROLLER SKATE VEHICLE WITH SEAT

CROSS-REFERENCE TO RELATED APPLICATIONS

Not Applicable

STATEMENT REGARDING FEDERALLY SPONSORED RESEARCH

Not Applicable

BACKGROUND OF THE INVENTION

This invention relates to a standard four-wheeled roller skate that has a padded seat instead of a boot or shoe.

Roller skates are widely available and typically consist of a skate frame and a boot or shoe which is attached to the frame to allow a user to wear a skate on each foot as a form of recreational footwear for wheeled locomotion. The skate frame is made up of a plate which has four rollers or wheels mounted in pairs at a front axle and a rear axle. The axles are attached to the plate with support trucks, the trucks typically having an optional single or double action. The boot or shoe is typically bolted or otherwise secured to the upper-surface of the plate.

The use of such roller skates requires a notable degree of coordination as well as exceptionally large and smooth surfaces on which to skate upon, which limits the use of such Roller skates to "roller rinks" and other specialized skating centers which are well known in the art.

By replacing the boot with a padded seat a single roller skate may be converted into an easily controlled, compact, low-profile vehicle capable of being ridden upon by a person of even limited coordination, such as a small child, upon virtually any surface, such as the floors of a home.

Skateboards or coasting boards are known in the art. Two examples of such boards are U.S. Pat. No. 5,114,166, to McCosker and U.S. Pat. No. 5,833,252, to Strand. The board disclosed by Strand is intended to have a user ride upon the board while standing. The board has an elongated riding surface to better provide purchase for the riders's feet, as well as independently mounted and moveable wheel carriages. The board disclosed by McCosker discloses a similar elongated board which has much larger wheels but retains the elongated riding surface as well as the independently mounted wheel carriages.

Unlike the present invention, the somewhat large size and elongated shape of the Strand and McCosker boards make them unsuitable for operation in the close confines of a typical home.

In light of the shortcomings described above, what is needed is a more compact roller vehicle which is capable of being readily controlled by a rider in a seated position.

BRIEF SUMMARY OF THE INVENTION

The invention is directed to a roller skate wherein the boot or shoe is replaced with a padded seat. Replacing the boot with a padded seat provides for a skate vehicle which may be ridden as opposed to worn. Such a vehicle may be used by a person of even limited coordination or skill, such as small children. By shifting of the riders weight upon the padded seat the skate may be steered. Such a vehicle may be propelled by gravity, such as on an inclined surface; by the application of force by the rider's feet or hands or by being pushed or pulled by an external force.

The compact size of the roller skate and padded seat provides a vehicle that may be used within the confines of a typical home.

The padded or formed seat allows the rider to engage in a variety of unique movements be repositioning themselves on the seat and by shifting their weight in any direction. For example, a rider may reposition his or herself in order to displace more of their weight to the front wheels of the vehicle. This action will allow the rear wheels to be brought slightly off of the ground due to the increased weight to the front of the vehicle.

When this action is accompanied by a shift in weight of the ridder to the right or left, the front wheels will pivot in an extremely tight turn in the desired direction. Such a maneuver is merely one example of the improved locomotion characteristics allowed by the present invention. Other maneuvers and uses of the present roller skate vehicle will be apparent to one of ordinary skill in the art.

BRIEF DESCRIPTION OF THE SEVERAL VIEWS OF THE DRAWINGS

A detailed description of the invention is hereafter described with specific reference being made to the drawings in which.

DETAILED DESCRIPTION OF THE INVENTION

Figure 1:
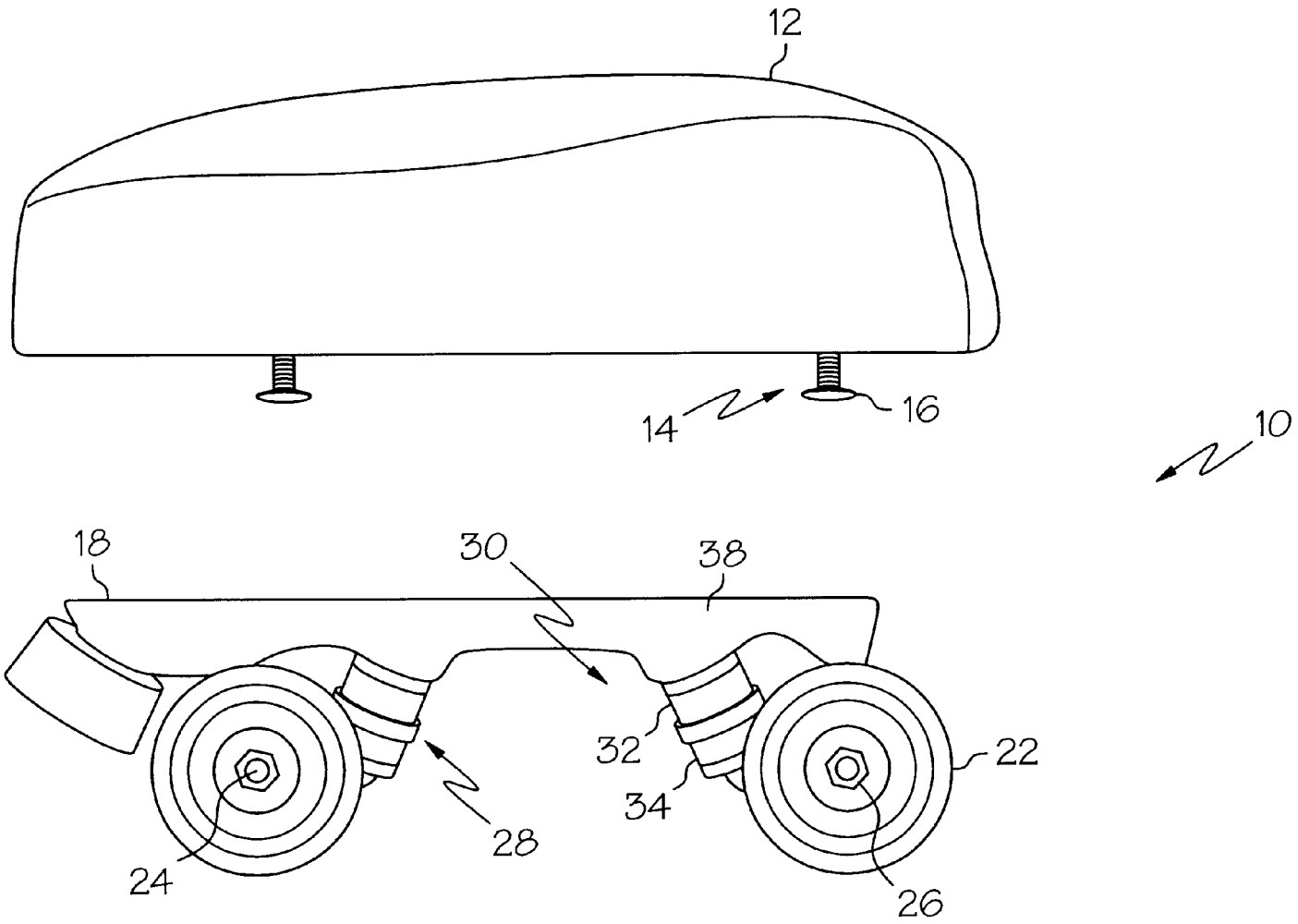
FIG. 1 is a side view of the present invention showing the padded seat prior to attachment to the roller skate frame

FIG. 1 shows a roller skate frame shown generally at 10, prior to having the padded seat 12 mounted thereon. The seat 12 has mounting fasteners 14 which have enlarged heads 16 which are used to secure the seat 12 to the upper surface of the plate 18. Alternatively the fasteners 14 could be replaced with any number of attachment devices such as screws, bolts, tabs, etc. Furthermore, glues or other adhesive materials could be used to secure the seat to the plate 18 as well.

Skate frames such as the one shown and described herein are commercially available, for example from Midwest Skate Company or any other skate frame manufacturer or seller. Likewise padded or formed seats are also commercially available in a wide variety of shapes and sizes. For example, the present padded seat 12 is seen with a slightly tapered shape and formed surface. However, other commercially available seats having widely diverse characteristics could also be used in the present invention.

Figure 2:
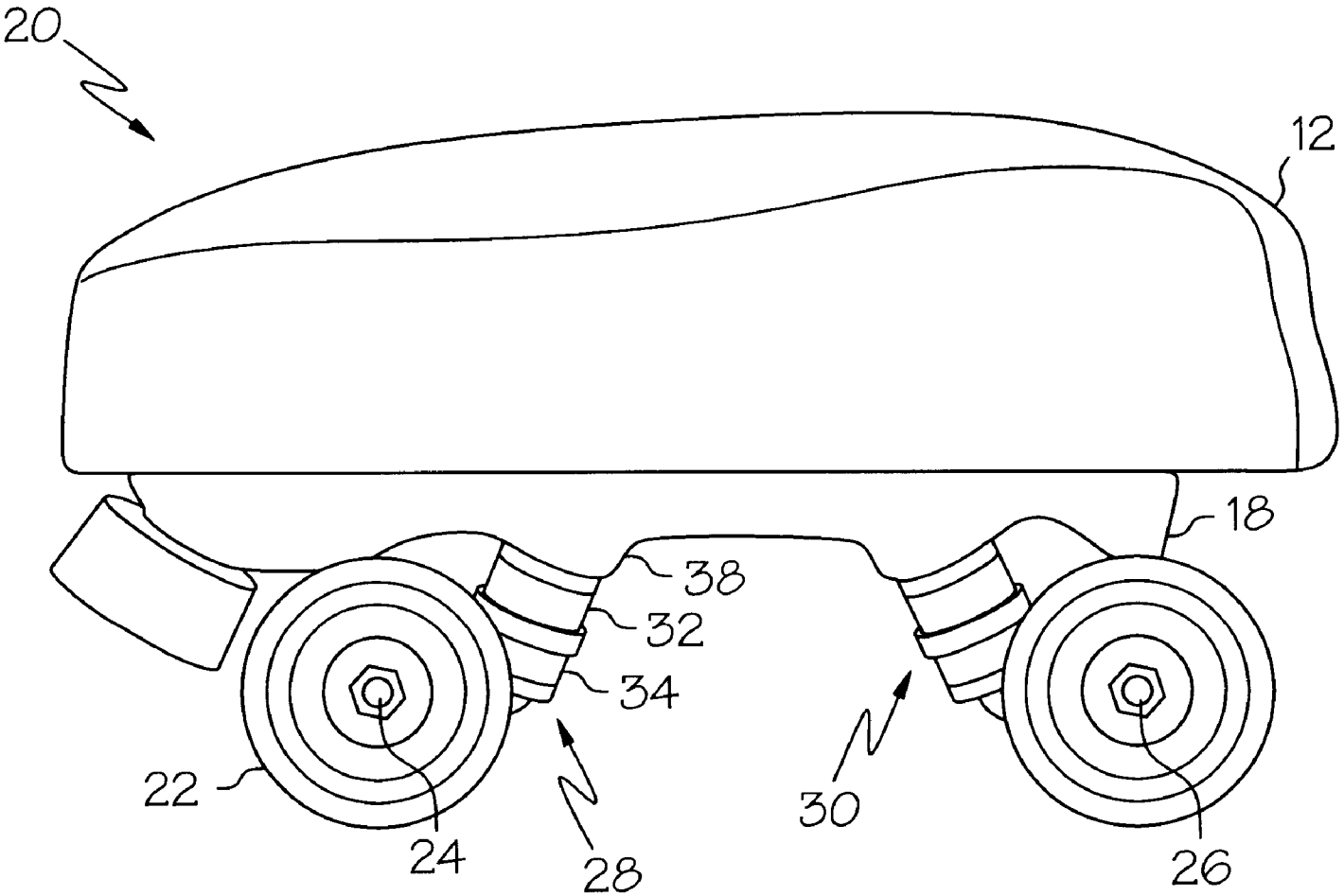
FIG. 2 is the same view as FIG. 1 showing the padded seat attached to the roller skate frame.

FIG. 2 shows the fully assembled roller skate vehicle 20.

Figure 3:
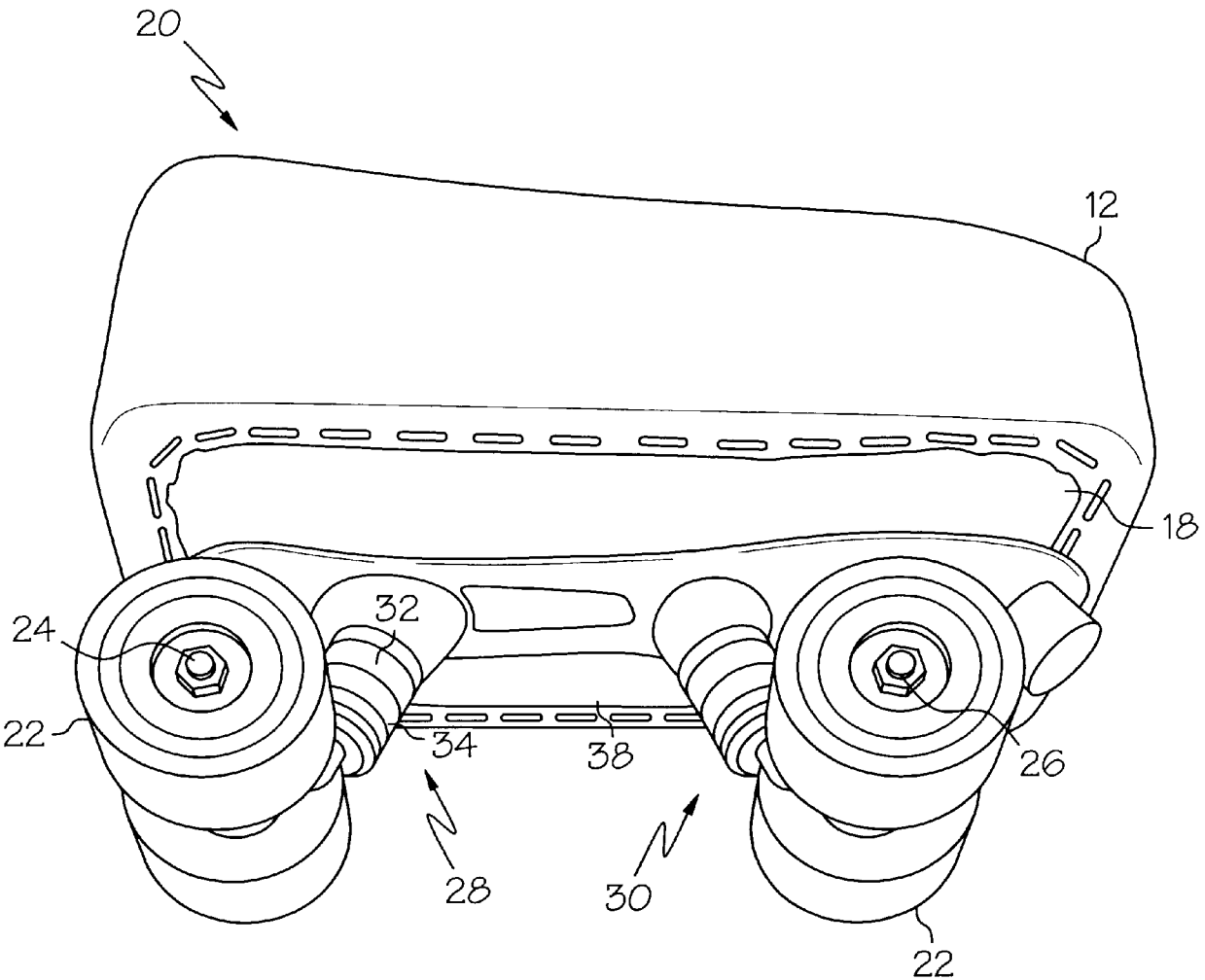
FIG. 3 is a perspective view of the invention showing the lower surface of the plate.

FIG. 3 shows an underside view of the completed roller skate vehicle 20. As best seen in FIG. 3 the roller skate frame has 4 wheels 22 mounted in pairs. The wheel pairs are attached respectively around a front axle 24 and a rear axle 26. The front axle 24 is mounted to a front truck assembly 28 while the rear axle 26 is mounted to a rear truck assembly 30. The truck assemblies shown in the various figures included herein are dual action assemblies having upper and lower rubber shock absorbers 32, 34 as are well known in the art. Alternative assemblies may be single action assemblies having only a single action, with a single shock absorber or otherwise. Alternative shock absorbers could be made out of silicon, plastic, or other materials all of which are well known in the art.

The truck assemblies 28, 30 are mounted to the plate 18. In the embodiment shown the plate 18 has two truck mounting regions 38 which ensures that the truck assemblies 28, 30 are always mounted in the same position relative to the plate 18. In alternative embodiments the truck assemblies 28, 30 may be variably mounted along the plate as desired by the user. In a further alternative embodiment the truck assemblies may be mounted directly to the padded seat 12 also in various positions as desired by the user.

Figure 4:
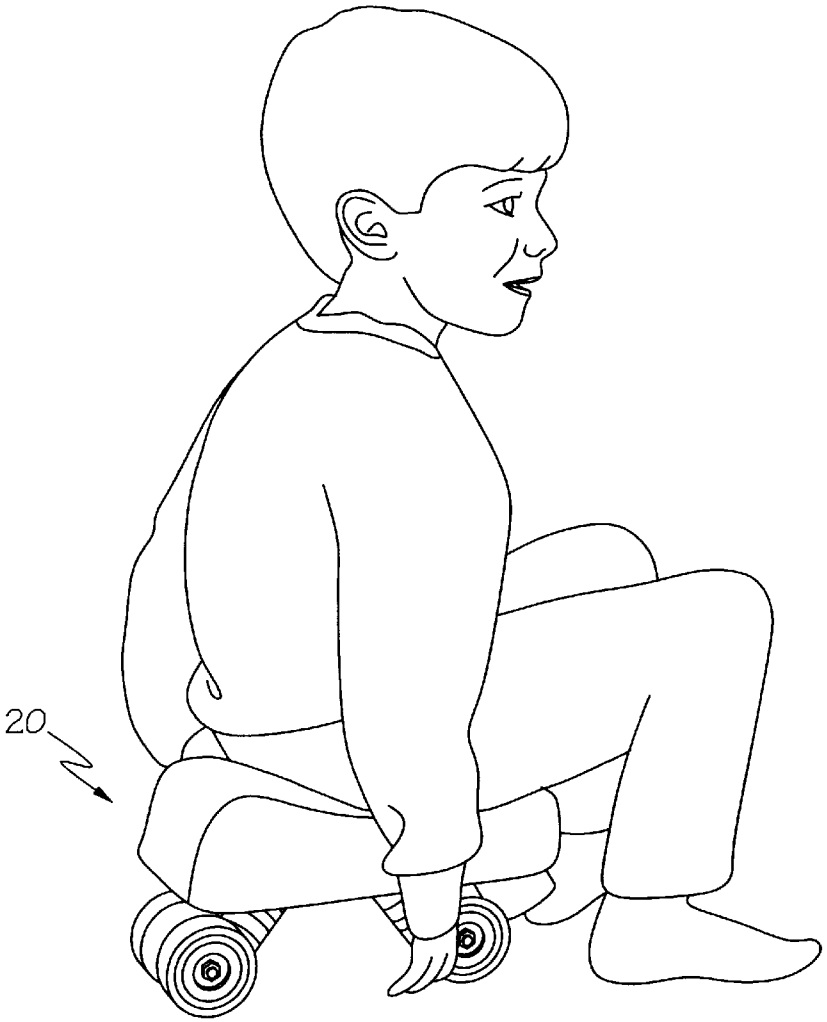
FIG. 4 shows the invention in use.

FIG. 4 shows the present invention as it may be used in the confines of a home.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A roller skate vehicle comprising a roller skate frame and a seat mounted to the roller skate frame, the skate frame further comprising a plate, the plate having an upper surface and a lower surface, two truck assemblies mounted to the lower surface of the plate, the truck assemblies each having a pair of spaced wheels mounted on an axle, the axles being spaced less than about 12 inches apart, the seat mounted to the upper surface of the plate, and extending beyond the axles.

2. The roller skate vehicle of claim 1, wherein the seat is a padded seat.

3. The roller skate vehicle of claim 1, wherein the seat is a formed seat.

4. A method for riding a roller skate vehicle comprising the steps of:

(a) providing a roller skate vehicle having a padded seat and a fame the frame including a plate, the plate having an upper surface and a lower surface, two truck assemblies mounted to the lower surface of the plate, the truck assemblies each having a pair of spaced wheels mounted on a common axle, the axles being spaced less than about 12 inches apart, the padded seat mounted to the upper surface of the plate and extending beyond the axles;

(b) placing the roller skate vehicle on the ground (c) sitting on the padded seat; and (d) riding the vehicle.

5. A method for riding a roller skate vehicle of claim 4 wherein the ground further comprises a floor of a home or other confined environment.

* * * * *